US009259602B2

(12) United States Patent
Robinet et al.

(10) Patent No.: US 9,259,602 B2
(45) Date of Patent: Feb. 16, 2016

(54) FIRE FIGHTING FOAM COMPOSITION AND METHOD OF USE

(75) Inventors: Nicolas E. Robinet, Reims (FR); Chantal Smett, Reims (FR)

(73) Assignee: Angus Holdings Safety Group Limited (GB)

( * ) Notice: Subject to any disclaimer, the term of this patent is extended or adjusted under 35 U.S.C. 154(b) by 0 days.

(21) Appl. No.: 14/003,643

(22) PCT Filed: Mar. 11, 2011

(86) PCT No.: PCT/IB2011/001065

§ 371 (c)(1),
(2), (4) Date: Nov. 14, 2013

(87) PCT Pub. No.: WO2012/123778

PCT Pub. Date: Sep. 20, 2012

(65) Prior Publication Data

US 2014/0138104 A1 May 22, 2014

(51) Int. Cl.

| | |
|---|---|
| ***A62D 1/02*** | (2006.01) |
| ***A62D 1/00*** | (2006.01) |
| ***A62C 99/00*** | (2010.01) |

(52) U.S. Cl.

CPC ..... *A62D 1/0071* (2013.01); *A62C 99/0036* (2013.01); *A62D 1/0042* (2013.01)

(58) Field of Classification Search

CPC ..... A62D 1/0071

See application file for complete search history.

(56) References Cited

U.S. PATENT DOCUMENTS

| | | | | |
|---|---|---|---|---|
| 4,999,119 | A * | 3/1991 | Norman et al. | 252/3 |
| 5,882,541 | A | 3/1999 | Achtmann | |
| 7,868,167 | B2 | 1/2011 | Harding et al. | |
| 2003/0100460 | A1 | 5/2003 | Winston et al. | |
| 2014/0138104 | A1 * | 5/2014 | Robinet et al. | 169/46 |

FOREIGN PATENT DOCUMENTS

| | | |
|---|---|---|
| WO | 9101160 | 2/1991 |
| WO | 9101160 A1 | 2/1991 |

OTHER PUBLICATIONS

International Search Report for corresponding application PCT/IB2011/001065 mailed Nov. 29, 2011.

Australian Examination Report for associated/related application 2011362297 date issued Mar. 11, 2014.

National Industrial Chemials Notification and Assessment Scheme, Full public report, Diutan gum. 2006. [retrieved on & Mar. 7, 2014] Retrieved from internet URL:http://www.nicnas.gov.au/_data/assets/pdf_file/0015/10509/STD1193FR.pdf.

Principles of Foam Fire Fighting, First Edition, International Fire Service Training Associateion, edited by M Wieder et al, © 1996 by the Board of Regents, Oklahoma State University, pp. 1-79 and 262-280.

Firefighting Strategies and Tactics, Third Edition, by James S. Angle, T. David Harlow, Michael F. Gala, Jr., William B Lombardo, and Craig M. Maciuba, Jones & Bartlett Learning, © 2015, available at: https://books.google.co.uk/books?id=_DcJwonIBKAC&printsec=frontcover&dq=fire+inspector+-+principles+and+practice&hl=en&sa=X&ved=0CCcQ6AEwAGoVChMI1cL3vveexwIVA53bCh0bkwAm#v=onepage&q=fire%20inspector%20-%20principles%20and%20practice&f=false, (pertinent screen shots attached).

Fire Inspector—Principles and Practice, by W Jennaway, International Association of Fire Chiefs, National Fire Protection Association, Jones & Bartlett Learning, © 2012, available at: https://books.google.co.uk/books?id=_DcJwonIBKAC&printsec=frontcover&dq=fire+inspector+-+principles+and+practice&hl=en&sa=X&ved=0CCcQ6AEwAGoVChMI1cL3vveexwIVA53bCh0bkwAm#v=onepage&q=fire%20inspector%20-%20principles%20and%20practice&f=false, (pertinent screen shots attached).

Fundamentals of Fire Fighter Skills, by D Schottke, International Association of Fire Chiefs, National Fire Protection Association, Jones & Bartlett Learning, © 2014, available at: https://books.google.co.uk/books?id=kp9VZIEnIO8C&printsec=frontcover&dq=fundamentals+of+fire+fighting+skills&hl=en&sa=X&ved=0CC0Q6AEwAGoVChMI34DZnfuexwIViVjbCh1rJwLZ#v=onepage&q=fundamentals%20of%20fire%20fighting%20skills&f=false, (pertinent screen shots attached).

* cited by examiner

*Primary Examiner* — Joseph D Anthony
(74) *Attorney, Agent, or Firm* — Polster Lieder

(57) ABSTRACT

A fire fighting foam composition is disclosed comprising water and diutan gum; and either one or more nonionic surfactants with one or more water-miscible organic solvents and with such composition comprising less than 0.35% by weight of a fluorinated surfactant; or an alkyl polyglycoside with one or more anionic surfactants and one or more glycol solvents and with such composition being substantially free of fluorinated surfactants.

17 Claims, No Drawings

FIRE FIGHTING FOAM COMPOSITION AND METHOD OF USE

CROSS-REFERENCE TO RELATED APPLICATIONS

This application is a National Stage of International Application No. PCT/IB2011/001065, filed Mar. 11, 2011, the disclosure of the above applications are incorporated herein by reference.

BACKGROUND OF THE INVENTION

Fire fighting foams such as aqueous film-forming foams (AFFF) and alcohol-resistant aqueous film-forming foams (AR-AFFF) have been widely used against fires fueled by flammable liquids (i.e., class B fires). These foams generally include water along with a film-forming agent such as a water-soluble polymer and one or more surfactants, optionally with one or more additives. Among the more effective surfactants have been a variety of fluorinated surfactant compounds. These compounds, however, can have long residual presence in the environment and have come under increasing scrutiny with respect to environmental regulations. Regulations restricting the use of these compounds have been promulgated or are being considered in a number of jurisdictions. The prospect of such environmental regulations may also have a negative impact on the commercial availability and/or drive up the cost of fluorinated surfactant compounds. This has in turn prompted a need for effective fire fighting foam compositions such as AFFF and AR-AFFF compositions that have limited amounts of or are free from fluorinated surfactant compounds. Additionally, there continues to be a need for new fluorinated surfactant-containing fire fighting foam compositions that may offer improved effectiveness, cost, or both.

BRIEF DESCRIPTION OF THE INVENTION

According to an exemplary embodiment, a fire fighting foam composition is provided comprising water;
diutan gum;
one or more surfactants; and
one or more water-miscible organic solvents.

In another exemplary embodiment, the fire fighting foam composition has a reduced fluorine content and/or fluorinated surfactant content, as described herein, or is substantially free of fluorine and/or fluorinated surfactant.

In another exemplary embodiment, a fire fighting foam composition is provided comprising water;
diutan gum;
an alkyl polyglycoside;
one or more anionic surfactants; and
one or more glycol solvents;
the fire fighting foam composition being substantially free of fluorinated surfactants.

DETAILED DESCRIPTION OF THE INVENTION

Diutan gum may be used in the compositions described herein in various amounts. In one exemplary embodiment, diutan gum may be present in a minimum amount of at least 1.6% by weight and in another exemplary embodiment at least 1.1% by weight. In another exemplary embodiment, diutan gum may be present in a maximum amount of less than or equal to 0.8% by weight and in another exemplary embodiment less than or equal to 0.6% by weight.

Diutan gum is a polysaccharide polymer having repeating units of D-glucose, D-gluconaric acid, and 6-deoxy L-mannose. One type of diutan gum useful in the compositions described herein may be characterized by the formula

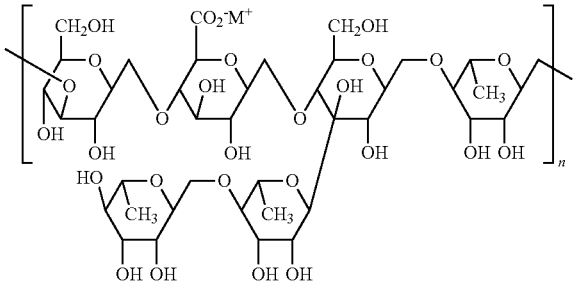

where and M is a cation that may be Na, K, or ½Ca and ½Mg and n is a number that is produced according to the techniques disclosed in U.S. Pat. No. 7,868,167, the disclosure of which is incorporated herein by reference in its entirety.

Diutan gum may be produced by biopolymer fermentation techniques as described, for example, in the above-referenced U.S. Pat. No. 7,868,167. The specific characteristics and properties of diutan gum may vary depending on the techniques by which it is manufactured. In an exemplary embodiment, the diutan gum used in the compositions described herein is a diutan gum as described in the above referenced U.S. Pat. No. 7,868,167. In another exemplary embodiment, the diutan gum used in the compositions described herein is KELCO-CRETE® DG-F biopolymer manufactured by CPKelco.

In some exemplary embodiments, the compositions described herein are free from, or contain only limited amounts of, fluorine including fluorine content derived from fluoro-substituted surfactants. Although not being bound by any particular theory or mechanism, it is believed that diutan gum provides water retention properties that are surprisingly able to provide useful foams without the use of or with only limited amounts of fluorinated surfactants. In some exemplary embodiments, the compositions described herein have less than 1% by weight of fluorine. In other exemplary embodiments, the compositions described herein have less than 0.5% by weight of fluorine. In still other exemplary embodiments, the compositions described are free of fluorine. In further exemplary embodiments, the compositions described herein have less than 2% by weight of fluorinated surfactants. In still further exemplary embodiments, the compositions described herein have less than 1% by weight of fluorinated surfactants. In still further exemplary embodiments, the compositions described are free of fluorinated surfactants.

The compositions described herein also include one or more surfactants. The amount of surfactant can vary widely depending on the particular surfactant or combination of surfactants, but can generally range between 5 and 12 weight percent of the fire fighting foam composition. Surfactants for fire fighting foam applications are well-known in the art, and include anionic surfactants, nonionic surfactants, amphoteric surfactants, and cationic surfactants. Anionic surfactants may include, for example, alkyl, alkyl ether, or alkylaryl sulfates (e.g., sodium lauryl sulfate, sodium lauryl ether sulfate), sulfonates (e.g., dioctyl sodium sulfosuccinate), or carboxylates.

In some exemplary embodiments, the alkyl or alkyl ether groups on the anionic surfactants may be substituted with substituents such as fluoro (except in cases where the fire fighting composition is fluorine-free, and may have from 8 to 16 carbon atoms, and from 8 to 10 carbon atoms in a more specific embodiment. In an exemplary embodiment, the one or more surfactants are selected from the group consisting of a C8-C10 alkyl sulfate, a C10-C14 alkyl ether sulfate, a succinate salt, and combinations including one or more of the foregoing. The amount of surfactant in the composition can vary widely depending on the type of surfactant(s) used Nonionic surfactants may include, for example, fatty alcohols (which in some embodiments have linear or branched C12 to C14 alkyl groups, e.g., cetyl alcohol, stearyl alcohol, oleyl alcohol), polyoxethylene or polyoxypropylene glycol alkyl or alkylphenol ethers (e.g., $CH_3—(CH_2)_{10-16}—(O—C_2H_4)_{1-25}—OH$, $CH_3—(CH_2)_{10-16}—(O—C_3H_6)_{1-25}—OH$, $CH_3—(CH_2)_{7-8}—C_6H_4—(O—C_3H_6)_{1-25}—OH$), block copolymers of polyoxyethylene and polyoxypropylene, and others as known in the art. A particularly useful class of nonionic surfactants for fire fighting foam are alkyl glycosides and polyglycosides as described, for example, in U.S. Pat. No. 5,207,932, the disclosure of which is incorporated herein by reference in its entirety.

Amphoteric surfactants may include, for example, a variety of compounds having an aliphatic portion having anionic moieties attached thereto along with amino or ammonium moieties. Examples include higher alkyl (C6-C14) betaines and sulfobetaines, CHAPS (3-[(3-cholamidopropyl)dimethylammonio]-1-propanesulfonate), cocamidopropyl hydroxysultaine, Solvents may include glycol ethers such as diethylene glycol monoalkyl ethers, ethylene glycol monoalkyl ether, propylene glycol monoalkyl ethers, dipropylene glycol monoalkyl ethers, as well as other hydroxyl-substituted ethers such as 1-butoxyethoxy-2-propanol. Other useful solvents may include various polyols such as higher alkyl glycols such as hexylene glycol, glycerine, and the like as described in various US patents, including U.S. Pat. Nos. 3,579,446, 3,422,011, 3,457,172, and 5,616,273, the disclosures of which are incorporated herein by reference in their entirety. The solvents used for their foam aid properties may also provide freeze protection for the foam or foam concentrate composition, but additional solvents may be included as part of an antifreeze package. Such antifreeze compounds may include lower alkyl glycols such as ethylene glycol, propylene glycol, propylene glycol, as well as salts and other solids that can reduce the freezing point, such as sodium, potassium, and urea.

The compositions described herein may also include various other additives such as sequestration agents, pH buffers, anticorrosion additives, antimicrobial additives, and the like as are well-known in the art as described, for example, in "A Firefighter's Guide to Foam", published by National Foam, Inc. or in BS EN 13565-1 and BS EN 13565-2, or in NFPA Standards, the disclosure of each of which is incorporated herein by reference in its entirety.

The fire fighting foam composition may also include, in addition to diutan gum, one or more other film formers or thickeners, including but not limited to water-soluble polymers such as described in US published patent application 2010/0276625A1, polysaccharide gums (e.g., xanthan gum, pectic acid, alginic acid, agar, rhamsam gum, welan gum, galactomannan gum, mannan gum), cellulose, dextran, hydroxyethyl cellulose, and starch.

The compositions described herein may be used as a concentrate in foam generating equipment using aspirated foam generating devices, non-aspirated foam generating devices, foam chambers, or sprinkler systems, as described in the above-referenced "Firefighters Guide to Foam", BS EN 13565 standards, or NFPA Standards. Foams may be applied directly to the flame or indirectly (i.e., applied to an adjacent surface and allowed to flow onto the flame). In one exemplary embodiment, dilution rates for generating a foam can range from 1% to 6%. The water used for dilution may be fresh, brackish, or sea water, or virtually any water-containing solution.

The compositions and their use are further described below in the following non-limiting examples.

EXAMPLES

Film-forming foam compositions (FFF) were prepared having the compositions (wt. %) as set forth in Table 1.

TABLE 1

| Ingredient | C. Ex. 1 | Ex. 1 | C. Ex. 2 | Ex. 2 |
|---|---|---|---|---|
| Water | 70.48% | 70.48% | 68.5% | 68.5% |
| Urea | 5% | 5% | 5% | 5% |
| Sodium alkyl sulfate surfactant | 1.76% | 1.76% | 3.08% | 3.08% |
| Sodium alkyl ether sulfate surfactant | 1.1% | 1.1% | 0% | 0% |
| Alkyl sulfosuccinate surfactant | 0.45% | 0.45% | 0% | 0% |
| Amphoteric perfluorinated surfactants | 0% | 0% | 0.349% | 0.349% |
| Alkyl glycoside | 0.48% | 0.48% | 0.3% | 0.3% |
| Fatty alcohol | 0.5% | 0.5% | 0% | 0% |
| Biocide Preservative | 0.00135% | 0.00135% | 0.00135% | 0.00135% |
| Diutan gum | 0% | 1.1% | 0% | 0.5% |
| Xanthan gum | 1.1% | 0% | 0.5% | 0% |
| Propylene glycol butyl ether | 6.16% | 6.16% | 0% | 0% |
| Propylene glycol | 9.36% | 9.36% | 0% | 0% |
| Butyl di-glycol | 0% | 0% | 9% | 9% |
| Ethylene glycol | 0% | 0% | 11.15% | 11.15% |

Materials were added stepwise, with the mixture maintained at 45° C. The diutan gum was added dissolved in the propylene glycol butyl ether, and the xanthan gum was added dissolved in the butyl di-glycol.

Each of the foam compositions was used at a 6% dilution to control a polar organic (acetone)-fueled fire and a non-polar organic (heptane)-fueled fire according to the Small Scale Fire Test as set forth in BS EN 1568:3 (2008) Annex I for the acetone-fueled fire and BS EN 1568:4 (2008) Annex I for the heptane-fueled fire. The results are set forth in Table 2 for the acetone-fueled fire and Table 3 for the heptane-fueled fire.

TABLE 2

| Acetone Fueled Small Scale Fire Test | | | | |
|---|---|---|---|---|
| | C. Ex. 1 | Ex. 1 | C. Ex. 2 | Ex. 2 |
| Concentration (%) | 6% | 6% | 6% | 6% |
| Temperatures: (° C.) | | | | |
| Water | 13 | 15 | 13 | 13 |
| Acetone | 15 | 15 | 15 | 15 |

TABLE 2-continued

| Acetone Fueled Small Scale Fire Test | | | | |
|---|---|---|---|---|
| | C. Ex. 1 | Ex. 1 | C. Ex. 2 | Ex. 2 |
| Ambient | 15 | 15 | 15 | 15 |
| x Application rate ($l/m^2$/min) | 6.5 | 6.5 | 6.5 | 6.5 |
| Time to percent of fire controlled (sec): | | | | |
| 50% | 13 | 14 | 21 | 21 |
| 80% | 20 | 23 | 33 | 33 |
| 90% | 29 | 30 | 45 | 40 |
| 99% | 36 | 36 | 55 | 45 |
| Extinction | 43 s | 42 s | 62 s | 50 s |
| Time of termination of foam application | 2 mn 00 s | 2 mn 00 s | 2 mn 00 s | 2 mn 00 s |
| Time of reignition commencement | 8 mn 00 s | 8 mn 38 s | 8 mn 30 s | 8 mn 30 s |
| Time of complete reignition | 12 mn 15 s | 13 mn 55 s | 12 mn 30 s | 12 mn 30 s |

TABLE 3

| Heptane Fueled Small Scale Fire Test | | | | |
|---|---|---|---|---|
| | C. Ex. 1 | Ex. 1 | C. Ex. 2 | Ex. 2 |
| Concentration (%) | 6% | 6% | 6% | 6% |
| Temperatures: (° C.) | | | | |
| Water | 15 | 14 | 13 | 15 |
| Heptane | 15.5 | 15 | 15 | 15.5 |
| Ambient | 17 | 18 | 15 | 17 |
| x Application rate ($l/m^2$/min) | 3 | 3 | 3 | 3 |
| Time to percent of fire controlled (sec): | | | | |
| 50% | 24 | 24 | 30 | 40 |
| 80% | 32 | 32 | 48 | 50 |
| 90% | 39 | 38 | 62 | 52 |
| 99% | 36 | 36 | 55 | 45 |
| Extinction | 45 | 44 | 70 | 57 |
| Time of termination of foam application | 2 mn 00 s | 2 mn 00 s | 2 mn 00 s | 2 mn 00 s |
| Time of reignition commencement | 11 mn 15 s | 11 mn 33 s | 8 mn 40 s | 10 mn 00 s |
| Time of complete reignition | 12 mn 50 | 13 mn 15 | 9 mn 30 s | 12 mn 30 s |

The results in Tables 2 and 3 illustrate that the diutan gum-containing foam compositions offer excellent fire suppression performance. In the fluorine-free compositions of Comparison Example 2 and Example 2, the diutan gum-containing foam composition of Example 2 provides significantly faster fire extinction with significantly longer (better) time for reignition to occur.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fire fighting foam composition for fighting a class B fire, comprising:

water;

diutan gum;

one or more nonionic surfactants; and one or more water-miscible organic solvents;

wherein the composition comprises less than 0.35% by weight of fluorinated surfactant.

2. The composition of claim 1, wherein the composition is substantially fluorine free.

3. The composition of claim 1, wherein the composition is free of any fluorinated surfactant.

4. The composition of claim 1, comprising from 0.1 to 1.5 percent by weight of diutan gum.

5. The composition of claim 1, wherein the one or more nonionic surfactants includes an alkyl polyglycoside.

6. The composition of claim 3, wherein the composition further includes one or more anionic surfactants.

7. The composition of claim 1, wherein the one or more nonionic surfactants includes a fatty alcohol.

8. The composition of claim 6, wherein the one or more anionic surfactants are selected from the group consisting of a C8-C10 alkyl sulfate, a C10-C14 alkyl ether sulfate, a succinate salt, and combinations including one or more of the foregoing.

9. A fire fighting foam composition for fighting a class B fire, comprising:

water;

diutan gum;

one or more nonionic surfactants including an alkyl polyglycoside;

one or more anionic surfactants; and one or more water-miscible organic solvents including one or more glycol solvents;

wherein said fire fighting foam composition is substantially free of fluorinated surfactants.

10. The composition of claim 9, wherein the one or more anionic surfactants are selected from the group consisting of a C8-C10 alkyl sulfate, a C10-C14 alkyl ether sulfate, a succinate salt, and combinations including one or more of the foregoing.

11. The composition of claim 9, wherein the one or more glycol solvents include an alkylene glycol, an alkylene glycol alkyl ether, or both an alkylene glycol and an alkylene glycol alkyl ether.

12. The composition of claim 9, further comprising urea.

13. The composition of claim 6, wherein the one or more anionic surfactants includes a C8-C10 alkyl sulfate.

14. The composition of claim 1, wherein the one or more water-miscible organic solvents include an alkylene glycol, an alkylene glycol alkyl ether, or both an alkylene glycol and an alkylene glycol alkyl ether.

15. The composition of claim 1, further comprising urea.

16. A method of fighting a class B fire, comprising forming a foam comprising the composition of claim 1, and applying the foam directly or indirectly onto the class B fire.

17. The method of fighting a class B fire, according to claim 16, wherein in the step of forming a foam the composition of the foam comprises:

one or more anionic surfactants; and one or more glycol solvents, and wherein the one or more nonionic surfactants includes an alkyl polyglycoside and said fire fighting foam composition is substantially free of fluorinated surfactants.

* * * * *